US005876029A

United States Patent [19]

Wright et al.

[11] Patent Number: 5,876,029

[45] Date of Patent: Mar. 2, 1999

[54] FEEDER ASSEMBLY APPARATUS

[75] Inventors: William J Wright, Killingworth; Carlos L DeFigueiredo, Sandy Hook, both of Conn.

[73] Assignee: Pitney Bowes Inc., Stamford, Conn.

[21] Appl. No.: 897,581

[22] Filed: Jul. 21, 1997

[51] Int. Cl.[6] ..... B65H 83/00

[52] U.S. Cl. ..... 271/3.18; 271/270; 271/10.03; 270/58.29; 270/58.23

[58] Field of Search ..... 270/58.23, 58.26, 270/58.29, 58.3, 58.25, 58.27; 271/3.18, 3.2, 4.04, 4.09, 4.1, 10.03, 270, 272, 273, 274

[56] References Cited

U.S. PATENT DOCUMENTS

| | | | |
|---|---|---|---|
| 2,427,839 | 9/1947 | Davidson | 270/58.29 |
| 2,920,888 | 1/1960 | Smith | 270/58.23 |
| 2,986,391 | 5/1961 | Walker | 270/58.23 |
| 3,175,821 | 3/1965 | Gibson | 270/58.29 |
| 3,891,202 | 6/1975 | Kircher | 270/58.25 |
| 3,965,644 | 6/1976 | Stocker | 270/58.29 |
| 4,373,711 | 2/1983 | Foster et al. | 271/171 |
| 4,801,036 | 1/1989 | Rathert | 270/58.29 |

*Primary Examiner*—William E. Terrell
*Assistant Examiner*—Patrick Mackey
*Attorney, Agent, or Firm*—Christopher J. Capelli; Melvin J. Scolnick; Robert Meyer

[57] ABSTRACT

The present invention relates to a sheet material feeder apparatus that includes a first feeder assembly positioned on an exit area of a sheet material storage compartment, which first feeder assembly is operative to provide a first driving force to a sheet material disposed in the storage compartment so as to convey the sheet material from the exit area of the storage compartment onto the main deck of an inserter system. The feeder apparatus further includes a second feeder assembly positioned on the main deck of the inserter system, which second feeder assembly is operative to provide a second driving force to the sheet material conveying through the first feeder assembly such that the sheet material is combined with the other sheet materials conveying along the main deck of the inserter system.

15 Claims, 6 Drawing Sheets

FEEDER ASSEMBLY APPARATUS

FIELD OF THE INVENTION

The present invention relates generally to multi-station document inserting systems, which assemble batches of documents for insertion into envelopes. More particularly, the present invention is directed toward insert feeder assemblies in multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

In regards to the insert feeders, they are critical to the operation of document inserting systems in that inserters play a significant role among the labor saving devices available to businesses which are engaged in the daily mailing of large numbers of mail pieces. Such feed inserters are well known, an example of which is described in commonly assigned U.S. Pat. No. 4,373,711 to Foster et al., hereby incorporated by reference. Among the advantages of inserter usage has been the reduction in personnel required to process large quantities of outgoing mail. Further, mailroom personnel have been relieved of the monotonous task of individually stuffing seemingly insurmountable numbers of envelopes. Inserters have been particularly well adapted for use in the mailing of form letters and the like and have been employed for the insertion of personalized documents, e.g. computer generated checks, cards, etc., into window envelopes.

Among the problems encountered with feeder assemblies are difficulties in feeding an insert from its storage tray onto the main paper deck of the inserting system when the main paper deck is conveying paper collations at a rather high speed. Such paper decks are capable of moving paper at sixty-seven (67) inches per second and beyond. At such speeds it is important that the inserts being fed from a storage tray associated with an insert feeder are conveyed to the paper deck at a speed that is approximately equal to the paper path speed on the main paper deck. However, present feeder assemblies only provide drive to an insert at the exit portion of the feeder assembly. Hence, when the insert leaves the feeder assembly no drive is provided to the insert: leaving only momentum forces and the forces of gravity to convey the insert from the feeder assembly (lying above the main paper deck) onto the main paper deck. Thus, inserts enter the main paper deck at a speed that is less than the paper deck speed causing improper positioning of the insert in the conveying paper path of the main deck. For instance, a portion of the insert may overlay a pushing finger that is advancing collations of paper along the main paper, consequently causing a paper jam in the inserting system.

Therefore, it is an object of the present invention to overcome the difficulties associated with feeder assemblies in conveying an insert from a storage tray onto a high speed paper deck of a document inserting system.

SUMMARY OF THE INVENTION

The present invention provides an apparatus and method for conveying an insert from a storage tray of a feeder assembly onto a high-speed paper deck of a paper inserting system. More particularly, the present invention continuously provides a driving force to an insert when it is being feed from a feeder assembly to the main paper deck of a paper inserting system.

In accordance with the present invention, the apparatus includes a feeder assembly for conveying sheet materials to a main deck of an inserter system from a storage compartment supported above the main deck. Preferably, the main deck of the inserter system includes a drive assembly for conveying other sheet materials along the main deck. The feeder assembly includes a first feeder assembly positioned on an exit area of a sheet material storage compartment, which first feeder assembly is operative to provide a first driving force to a sheet material disposed in the storage compartment so as to convey the sheet material from the exit area of the storage compartment onto the main deck of the inserter system. The feeder assembly further includes a second feeder assembly positioned on the main deck of the inserter system, which second feeder assembly is operative to provide a second driving force to the sheet material conveying through the first feeder assembly such that the sheet material is combined with other sheet materials conveying along the main deck of the inserter system.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
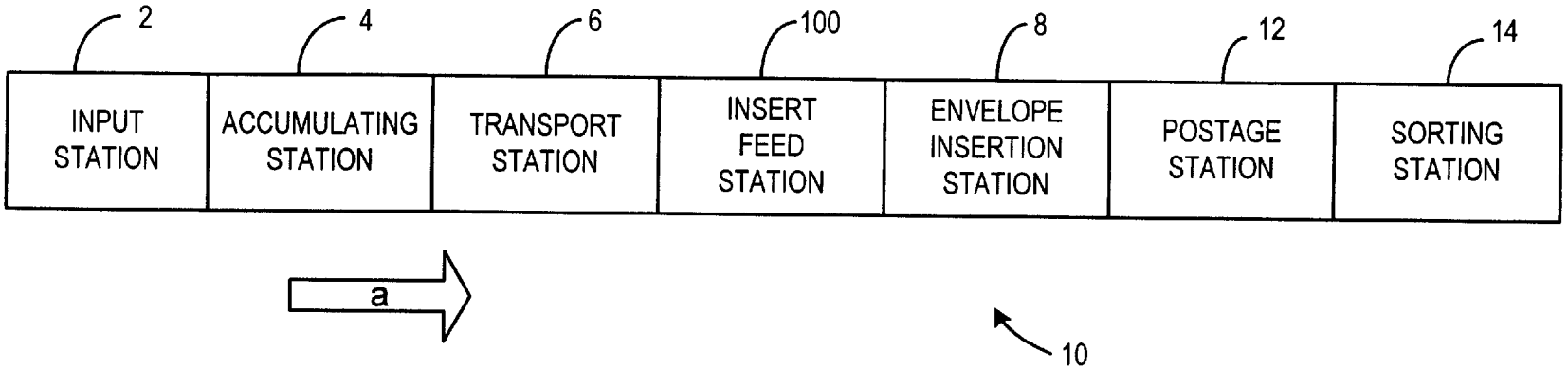
FIG. 1 is a schematic of a document inserting system in which the present invention is incorporated.

In describing the preferred embodiment of the present invention, reference is made to the drawings, wherein there is seen in FIG. 1 a schematic of a typical document inserting system, generally designated 10, which implements the present invention insert feeder assembly 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

Figure 2:
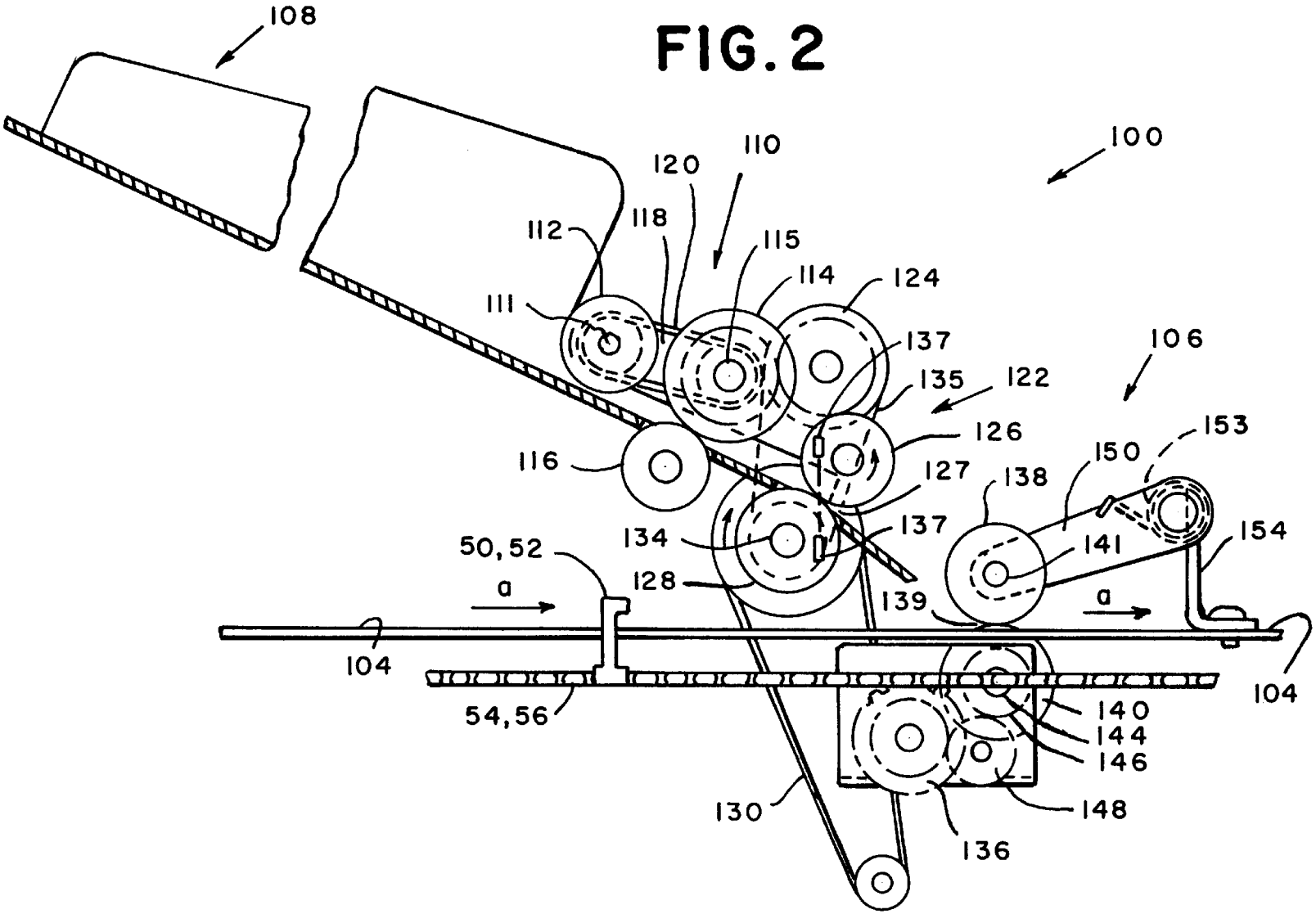
FIG. 2 is a cross-sectional view of an embodiment of the present invention feeder assembly implemented in the document inserting system shown in FIG. 1.
Figure 3:
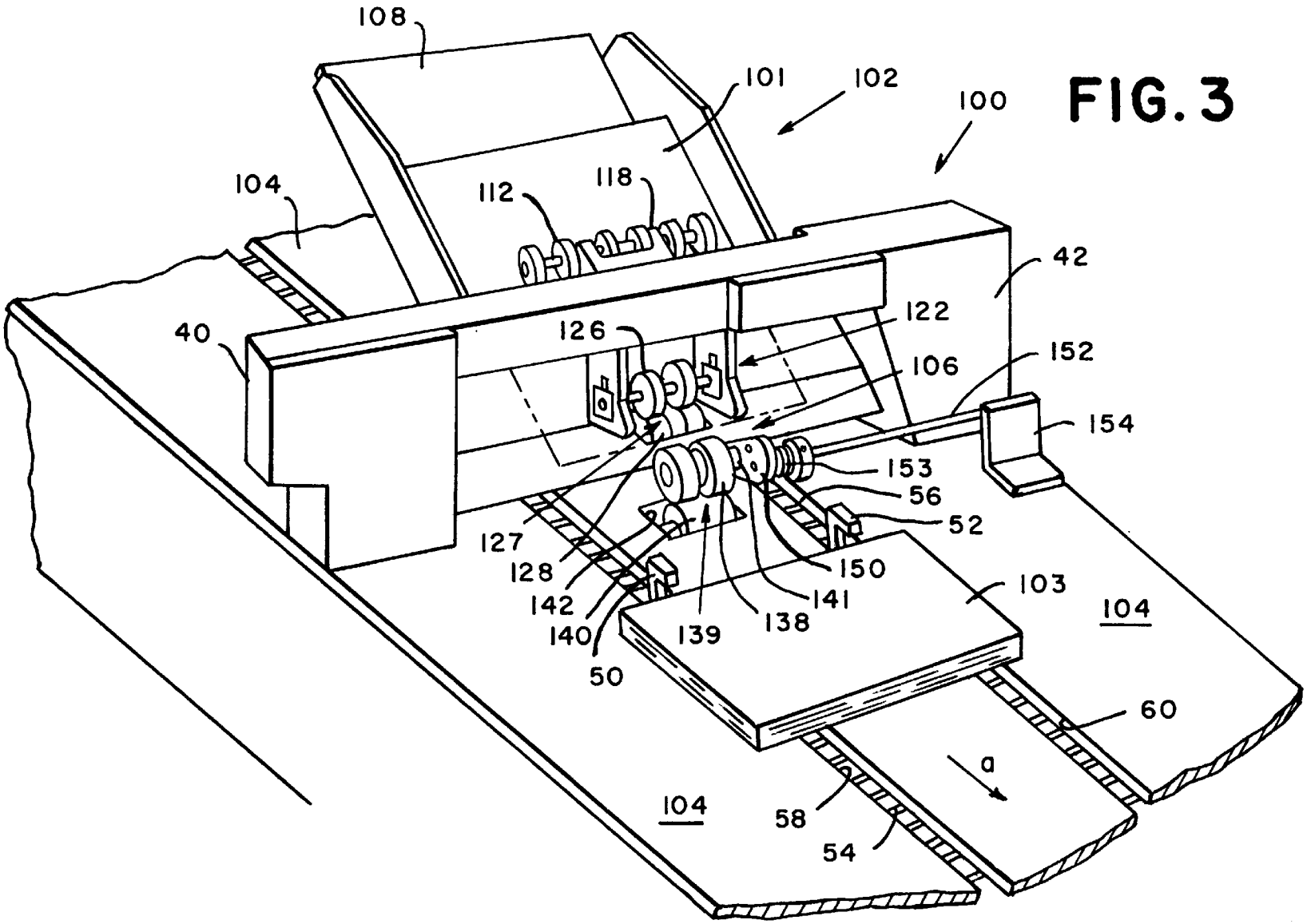
FIG. 3 is a perspective view of the feeder assembly shown in FIG. 2.

System 10 preferably includes an input station 2 that feeds paper sheets (preferably from a paper web) to an accumulating station 4 that accumulates the sheets of paper. Essentially, input station 2 feeds sheets in a paper path, as indicated by arrow "a," along what is termed the "main deck" of inserter system 10. It is to be appreciated that such an input station consist of well known devices such as, but not limited to, a sheet burster, a cut sheet feeder, a sheet transporter, etc. Further, such an accumulating station is well known, an example of which is described in commonly assigned U.S. Pat. No. 5,083,769, hereby incorporated by reference. The accumulated sheets are then conveyed to a transport station 6 (also well known in the art), preferably operative to perform buffering operations for maintaining a proper timing scheme for processing documents in inserting system 10. It is pointed out, and as is well known, that the accumulation of sheets are conveyed along the main deck of inserter system 10 through the action of a pair of advancing pusher fingers 54 and 56 (FIGS. 2 and 3). Essentially, the pusher fingers 50 and 52 maintain the integrity of the sheet accumulation as well as provide the force necessary to convey the accumulation of sheets through inserter system 10.

The accumulation of sheets are feed from transport station 6 to the present invention insert feeder station 100. It is to be appreciated that a typical inserter system 10 includes a plurality of feeder stations, but for clarity of illustration only a single insert feeder 100 is shown in the drawings depicting the inserter system 10 implementing the present invention. As will be discussed in more detail below, insert feeder 100 is operational to convey an insert (e.g., an advertisement) into the aforesaid accumulation of sheets being conveyed along the main deck of inserter 10.

The accumulation of sheets (containing the insert) are then conveyed into an envelope insertion station 8 that is operative to insert the accumulation into an envelope, which envelope is preferably thereafter sealed and addressed. The envelope is then conveyed to postage station 12 that applies appropriate postage thereto. Finally, the envelope is preferably conveyed to a sorting station 14 that sorts the envelopes in accordance with postal discount requirements.

As is conventional, inserter system 10 includes a control system (not shown) that controls and harmonizes operation of the various stations implemented in inserter system 10. Such a control system is well known in the art and since it forms no part of the present invention, it is not described in detail in order not to obscure the present invention. Similarly, since none of the other above-mentioned stations (namely: input station 2, accumulating station 4, transport station 6, envelope insertion station 8, postage station 12 and sorting station 14) form no part of the present invention insert feeder station 100, further discussion of each of these stations is also not described in detail in order not to obscure the present invention. Further, it is to be appreciated that the embodiment of inserter system 10 implementing the present invention insert feeder station 100 is only to be understood as an example configuration of such an inserter system 10. It is of course to be understood that such an inserter system may have many other configurations in accordance with a specific user's needs.

Referring now to FIGS. 2 and 3, the present invention insert feeder 100 is shown. Insert feeder 100 consists of a storage tray assembly 102 supported above the main deck 104 of inserter system 10. Insert feeder 100 further consists of a main deck insert drive assembly 106 having components aligned in the paper path (as indicated by arrow "a") on the main deck 104 of inserter system 10. Storage tray assembly 102 is mounted between a pair of side plates 40 and 42, each upstanding from the sides of the main deck 104. As will be discussed in more detail below, storage tray assembly 102 is operational to convey an insert 101 from storage tray assembly 102 onto the main deck 104 of inserter system 10, which conveyance occurs from a location above the main deck 104. Insert drive assembly 106 then provides positive drive to the insert 101 (being conveyed from storage tray assembly 102) when the leading edge of the conveying insert comes into proximity of the main deck 104.

As mentioned above, a pair of pusher fingers 50 and 52 are provided in inserter system 10 to convey an accumulation of sheets along the main deck 104 for processing in the various stations of inserter system 10. As is conventional, pusher fingers 50 and 52 are substantially parallel to one another and are orthogonal relative to the longitudinal axis defined by the paper path on the main deck 104 (as represented by arrow "a" in FIG. 3). Each pusher finger 50 and 52 is coupled to a respective elongate drive device 54 and 56 (e.g., a drive chain) for providing drive to each pusher finger 50 and 52. Drive is provided to each elongate drive device 54 and 56 through conventional motor driven means implemented throughout inserter system 10 (e.g., motors, pulleys, belts, etc.) (not shown). Each pusher finger 50 and 52 extends through an elongate opening 58 and 60 (FIG. 3) formed in the main deck 104 of inserter system 10. A bottom portion of each pusher finger 50 and 52 is connected to a respective elongate drive device 54 and 56, and a top portion of each pusher finger 50 and 52 (which top portion conveys the sheet accumulation) extends above the main deck 104.

In regards to storage assembly 102 of feeder assembly 100, it includes a storage tray 108 for storing a stack of inserts. A separator roller assembly 110 is provided for individually feeding an insert from the stack of inserts disposed in storage tray 108 and includes biased drive roller 112, separator drive roller 114 and fixed separator stone roller 116. Biased drive roller 112 pivotably extends from drive roller 114 by having its shaft 111 mounting to an end of pivoting arm member 118, which arm member 118 has its opposing end pivotably mounted to a shaft 115 that is concentric with separator drive roller 114. A spring mechanism (not shown) (e.g., a torsion spring) is preferably used to downward bias arm member 118, and in turn, drive roller 112, relative to separator drive roller 114. An endless belt 120 is operatively connected to rollers 112 and 114 providing counter-clockwise drive to biased drive roller 112. Biased drive roller 112 is functional to advance the topmost insert 101 from the stack of inserts disposed in storage tray 108 to the nip formed by rollers 114 and 116.

The nip formed by separator drive roller 114 and fixed separator stone roller 116 is functional to ensure that only a single (not more than one) insert is fed to the feed roller assembly 122 provided at the exit area of insert storage assembly 102. Counterclockwise drive is provided to separator drive roller 114 through preferably the inter-digitation of gears provided on drive roller 114 with a clutch mechanism 124.

Clutch mechanism 124 receives its driving force from drive roller 128, via pulley 135. It is noted that clutch mechanism 124 is under the control of the control system for inserter system 10, which control system includes a sensor assembly 137 for detecting the passage of an insert 101 through the feed roller assembly 122. It is to be appreciated that such a clutch mechanism and sensor assembly are well known in the art and thus do not need to be discussed in any further detail. The arrangement and functionality of separator drive roller 114 with fixed separator stone roller 116 is also well known in the art and thus further discussion thereof is also not necessary.

Feed roller assembly 122 includes idler roller 126 forming a nip 127 with drive roller 128. Clockwise drive is provided to drive roller 128 by endless belt 130 which wraps around a pulley 132 having a shaft 134 concentrically mounted with drive roller 128, wherein belt 130 receives its drive from a conventional motor (not shown). It is noted that endless belt 130 causes drive roller 128 to continuously rotate at a speed in correspondence with the speed of chains 54 and 56, since the speed of belt 130 depends from the speed of chains 54 and 56, via gear/pulley 136. Feed roller assembly 122 is functional to convey an insert 101 from storage assembly 102 onto the main deck 104 of inserter system 10, whereby the leading edge of the insert is directed towards the aforesaid insert drive assembly 106 provided on the main deck 104. In other words, the storage assembly 102 expels a single insert 101 onto the main deck 104 of the inserter system 10.

With continued reference to FIGS. 2 and 3, the main deck drive assembly 106 includes an idler roller 138 forming a nip 139 with a drive roller 140. It is pointed out that the distance between the nip 139 of the main deck drive assembly 106 and the nip 127 of the feed roller assembly 122 is preferably less than the lengthwise distance of an insert being conveyed from storage assembly 102, the significance of which will become apparent below. An outer circumference portion of drive roller 140 extends through a cutout 142 formed in the main deck 104 (FIG. 3). Continuous clockwise drive is provided to drive roller 140 by shaft 144, which is concentrically mounted with gear 146. Continuous clockwise drive is provided to gear 146 through its inter-digitation with gear 148, which in turn is provided with its continues counter-clockwise drive through its inter-digitation with gear/pulley 136, which gear/pulley 136 is provided with continues drive from chains 54 and 56.

Forming the nip 139 with drive roller 140 is idler roller 138, which is spring biased toward drive roller 140. As best shown in FIG. 3, idler roller 138 has a shaft 141 rotatably mounted to an end of arm member 150, which arm member 150 has its other end pivotably mounted to an end region of shaft 152. A torsion spring 153 is provided on the end region of shaft 152 and is functional to bias arm member 150 and attached idler roller 138 toward drive roller 140. Shaft 152 extends across the main deck 104 and has it opposing end mounted to an upstanding post 154 extending from a position at the side portion of the main deck 104, which position is not in obstruction of the paper path (as indicated by arrow "A") prescribed on the main deck 104.

Therefore, the main deck drive assembly 106 is operational to provide a driving force on the main deck 104 to an insert being conveyed form the storage assembly 102 lying above the main deck 104. Thus, even after the tail edge portion of an insert has left the drive nip 127 of feed roller assembly 122 provided on the storage assembly 102, a driving force is still being effected upon the conveying insert, via the drive nip 139 of the main deck drive assembly 106. It is noted that the drive nip 139 of the main deck drive assembly 106 causes an insert to be conveyed into the paper path on the main deck 104 at a speed in correspondence to the main deck paper path speed since the rotational speed of drive roller 140 depends from the speed of chains 54 and 56 (which advance pusher fingers 50 and 52), via gears 136, 140 and 148.

Figure 4:
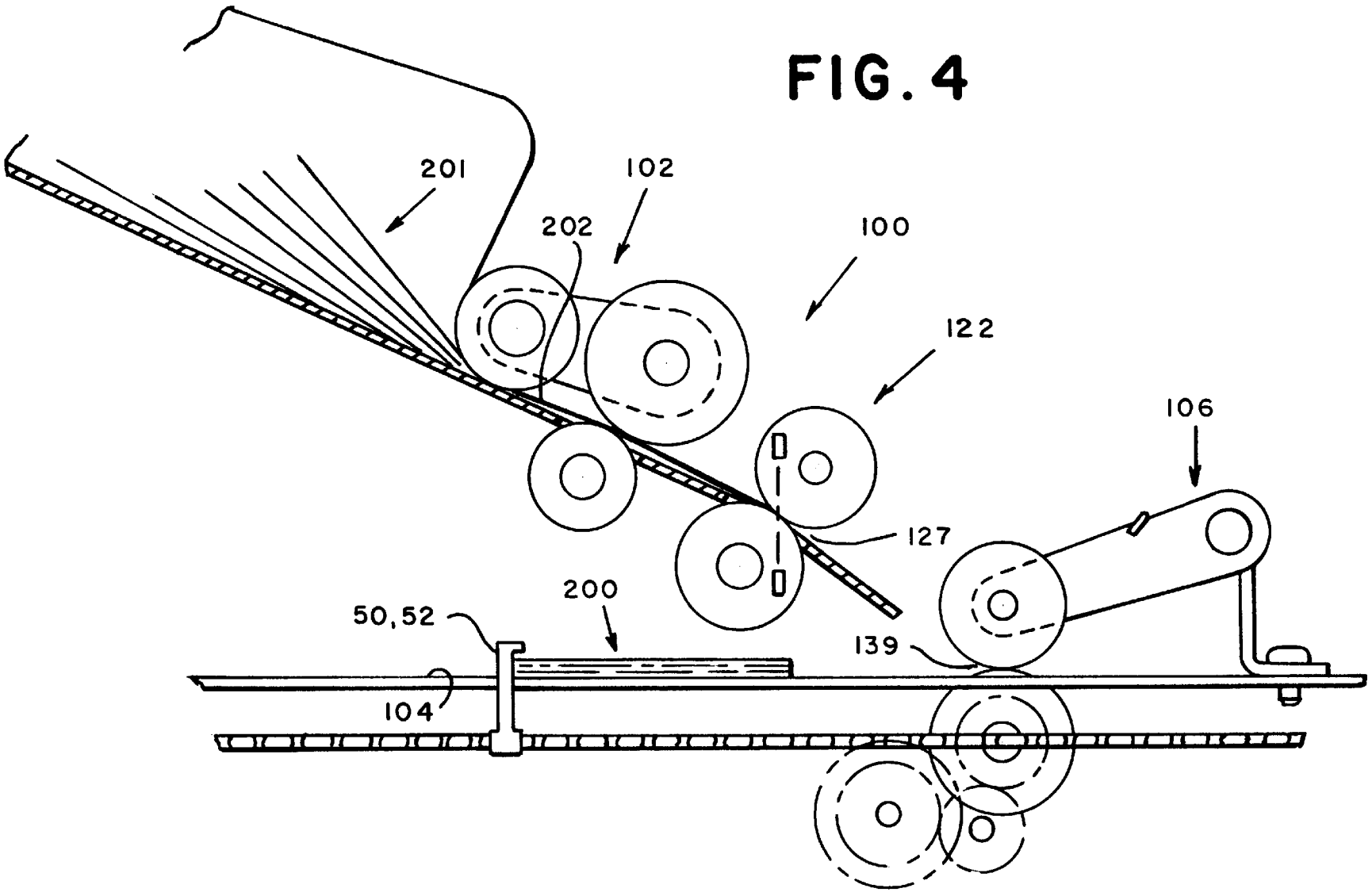
FIGS. 4–6 are planar views of the feeder assembly of FIG. 3 depicting the conveyance of a document insert from the storage tray of the feeder assembly onto the main paper deck of the document inserting system.
Figure 5:
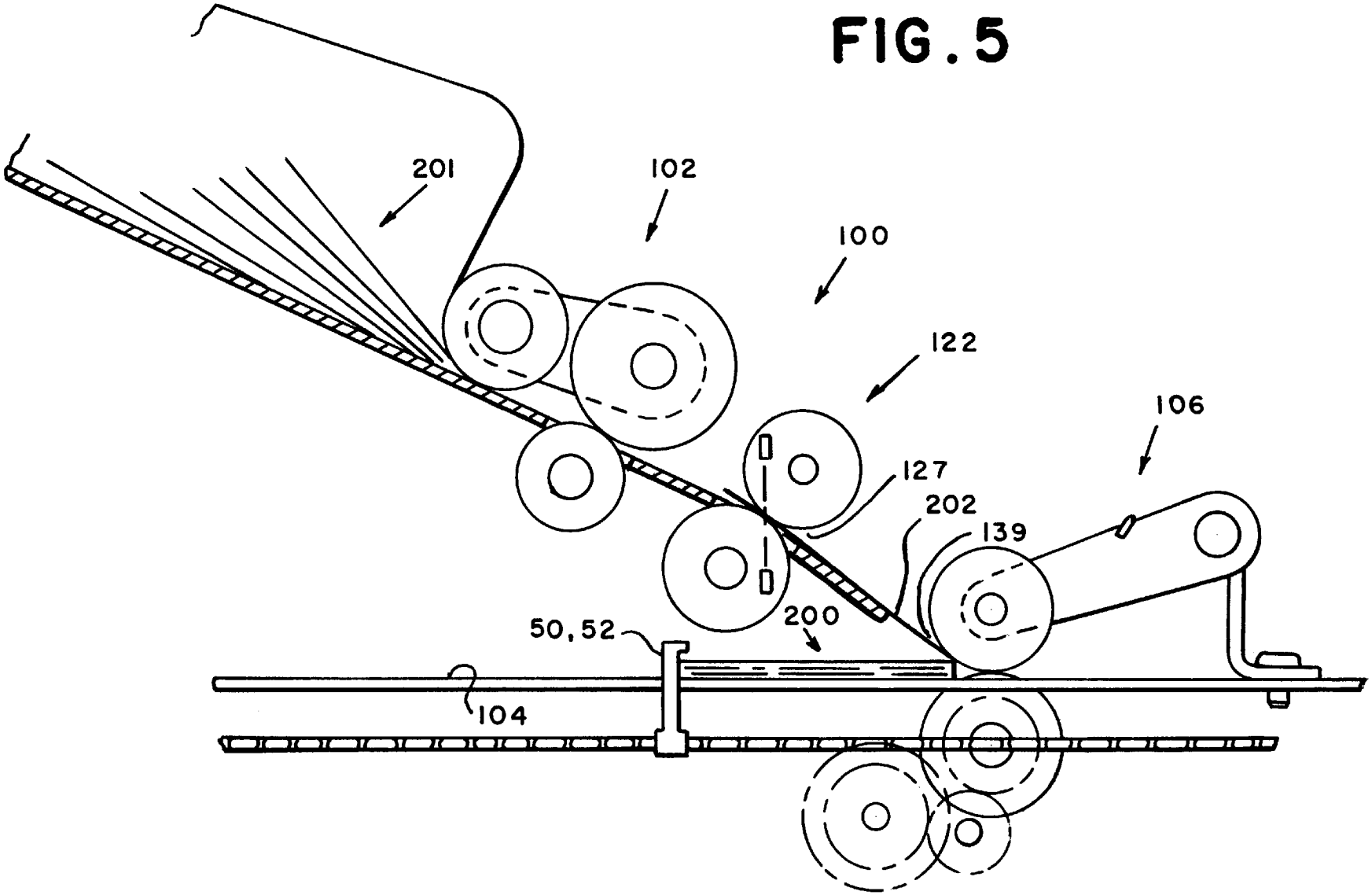
Figure 6:
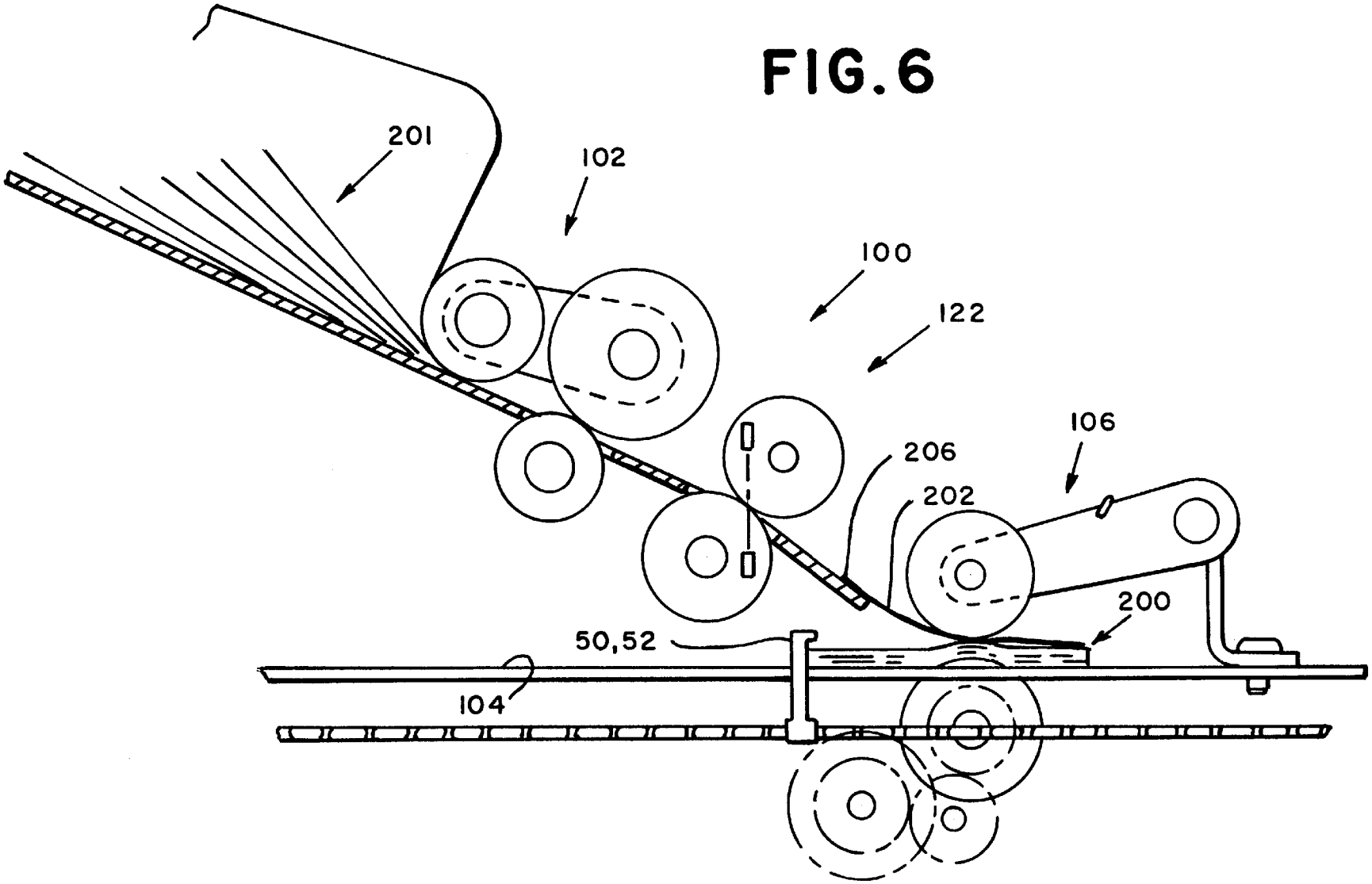

With the basic elements of system 10 being described above, discussion will now turn toward its method of operation with reference to FIGS. 4–6. Referring first to FIG. 4, as the pusher fingers 50 and 52 push an accumulation of sheets 200 along the paper path of the main deck 104 and into the present invention feeder assembly 100, the separator roller assembly 102 causes a single insert 202 to be fed from a stack of inserts 201 disposed in the storage tray 108 into the drive nip 127 of the feed roller assembly 122. Referring now to FIG. 5, as the pusher fingers 50 and 52 continue to convey the accumulation of sheets through the feeder assembly 100 in the paper path on the main deck 104, the drive nip 127 of the feed roller assembly 122 expels the insert 202 from the storage tray assembly 102 onto the conveying accumulation of sheets 200 advancing in the paper path on the main deck 104 of inserter system 10.

Before the tail edge portion 206 of the insert 202 is expelled from the drive nip 127 of the feed roller assembly 122, the leading edge portion 208 of the insert 202 enters into the drive nip 139 of the main deck drive assembly 106. Drive nip 139 of the main deck drive assembly 106 thereafter continues to provide a driving force to the insert 202 now nested with the accumulation of sheets 200, even after the insert has been expelled from the drive nip 127 of the feed roller assembly 122, as shown in FIG. 6.

Therefore, an advantage of the present invention feeder assembly 100 is that it provides a continues driving force upon an insert from the time it is conveyed through, and expelled from, a storage tray assembly until the time the insert is nested with an accumulation of sheets on the main deck of an inserter system. As mentioned above, this is particularly advantageous in high speed inserter systems where the lag time of when an insert is expelled from a storage tray (in which no driving force is effected upon the insert) until it is nested with the accumulation of sheets on the main deck can cause improper placement of the insert relative to the accumulation of sheets it is intended to be nested with, causing a paper jam in the inserter system.

In summary, a feeder assembly for providing continues drive to a conveying insert has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A feeder apparatus for conveying sheet materials to a main deck of an inserter system from a storage compartment supported above the main deck, the main deck having a drive assembly for conveying other sheet materials along the main deck of the inserter system, the feeder assembly comprising:

a first feeder assembly positioned on an exit area of the storage compartment, the first feeder assembly is operative to provide a first driving force to the sheet material so as to convey the sheet material from the exit area of the storage compartment onto the main deck of the inserter system, and a second feeder assembly positioned on the main deck of the inserter system separate from said main deck drive assembly, the second feeder assembly is operative to provide a second driving force to the sheet material such that the sheet material is combined with the other sheet materials conveying along the main deck whereby said main deck drive assembly provides a third driving force to said sheet material.

2. A feeder apparatus as recited in claim 1, wherein the second feeder assembly is spaced from the first feeder assembly at a distance that is less than the length of the sheet material being conveyed from the storage compartment such the second feeder assembly is providing the second driving force during and after the sheet material is conveying through the first feeder assembly.

3. A feeder apparatus as recited in claim 1, wherein the second feeder assembly includes a drive roller forming a nip with an idler roller biased against the drive roller whereby the drive roller is mounted below the main deck and a portion of its outer circumference extends through a cutout defined in the main deck and the idler roller is supported from a location above the main deck of the inserter system.

4. A feeder apparatus as recited in claim 1, wherein the second feeder assembly is operative to convey the sheet material from the storage compartment onto the main deck at a speed that is approximately equal the speed of the other materials on the main deck being conveyed by the main deck drive assembly.

5. A feeder apparatus as recited in claim 1 further including a:

a separator roller assembly mounted between the first feeder assembly and the sheet material storage compartment, the separator roller assembly is operative to remove an individual sheet from a stack of sheets disposed in the storage compartment and advance the individual sheet to the first feeder assembly.

6. A feeder apparatus as recited in claim 5, wherein the separator roller assembly includes a fixed separator stone adapted to engage the undersurface of the individual sheet material to prevent multiple feeding of sheet materials to the first feeder assembly.

7. An inserter system having an input station for feeding sheets of material onto a main deck defined by the inserter system, the main deck having a pair of parallel extending sides and a drive assembly positioned between the parallel extending side edges for conveying sheets of material from the input station to a feeding apparatus positioned downstream of the input station, the feeding apparatus comprising:

a storage tray assembly supported between the sides, and above of, the main deck of the inserter system, the storage tray assembly including:

(a) a storage compartment configured to store a stack of sheet material; and (b) a first feeder assembly positioned on an exit area of the storage tray assembly and being operative to provide a first driving force for conveying a sheet material from the stack of sheet material disposed in the storage compartment to the main deck of the inserter system; and a second feeder assembly positioned on the main deck on the inserter system in close proximity to the first feeder assembly and separate from the drive assembly of said main deck, the second feeder assembly is operative to provide a second driving force to the sheet material advancing from the first feeder assembly such that the sheet material is combined with the other sheet materials conveying along the main deck from the first input station deck whereby said main deck drive assembly provides a third driving force to said sheet material.

8. An inserter system as recited in claim 7, wherein the drive assembly on the main deck includes first and second parallel spaced pusher fingers each extending through respective first and second elongate cutouts defined in the main deck.

9. An inserter system as recited in claim 8, wherein the drive assembly includes first and second elongate drive belts provided below the main deck and respectively connected to a portion of the first and second pusher fingers extending below the main deck, the first and second elongate drive belts are operative to advance the first and second pusher fingers through the respective first and second elongate cutouts defined on the main deck.

10. An inserter system as recited in claim 7, wherein the second feeder assembly is spaced from the first feeder assembly at a distance that is less than the length of the sheet material being conveyed from the storage compartment such the second feeder assembly is providing the second driving force during and after the sheet material is conveying through the first feeder assembly.

11. An inserter system as recited in claim 10, wherein the second feeder assembly includes a drive roller forming a nip with an idler roller biased against the drive roller whereby the drive roller is mounted below the main deck and a portion of its outer circumference extends through a cutout defined in the main deck and the idler roller is supported from a location above the main deck of the inserter system.

12. An inserter system as recited in claim 11, wherein the second feeder assembly is operative to convey the sheet material from the storage compartment onto the main deck at a speed that is approximately equal the speed of the other materials on the main deck being conveyed by the main deck drive assembly.

13. An inserter system as recited in claim 12, wherein at least one of the first and second elongate drive belts is operatively associated with the drive roller of the second feeder assembly so as to provide a driving force thereto.

14. An inserter system as recited in claim 13 further including a:

a separator roller assembly mounted between the first feeder assembly and the sheet material storage compartment, the separator roller assembly is operative to remove an individual sheet from a stack of sheets disposed in the storage compartment and advance the individual sheet to the first feeder assembly.

15. An inserter system as recited in claim 14, wherein the separator roller assembly includes a fixed separator stone adapted to engage the undersurface of the individual sheet material to prevent multiple feeding of sheet materials to the first feeder assembly.

* * * * *